US007268283B1

(12) United States Patent
Sikra

(10) Patent No.: US 7,268,283 B1
(45) Date of Patent: Sep. 11, 2007

(54) DRUM SUPPORT STRUCTURE

(75) Inventor: Richard A. Sikra, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 110 days.

(21) Appl. No.: 11/115,759

(22) Filed: Apr. 28, 2005

(51) Int. Cl.
*G10D 13/02* (2006.01)

(52) U.S. Cl. ..... 84/421; 84/411 R

(58) Field of Classification Search ..... 84/421; D17/22

See application file for complete search history.

(56) References Cited

U.S. PATENT DOCUMENTS 4,126,075 A * 11/1978 Kurosaki ..... 84/421
5,973,249 A * 10/1999 Liao ..... 84/421
6,091,011 A * 7/2000 Simons et al. ..... 84/421
6,459,027 B1 * 10/2002 Van Dermeulen ..... 84/421

* cited by examiner

*Primary Examiner*—Edwin A. Leon
(74) *Attorney, Agent, or Firm*—William W. Haefliger

(57) ABSTRACT

Apparatus for clamping two drums to an upright support, the drums each having a projecting bracket or brackets, defining at least one through opening, comprising a carrier body connectable to the upright support, posts on the carrier body receivable in bracket openings, and adjustable mechanism on the carrier body for displacing at least one of the posts relative to at least one bracket opening to clamp at least two posts against the brackets. Certain posts may be carried by structure connected to the drums; and certain post receiving openings may be carried by the upright support.

14 Claims, 6 Drawing Sheets

11
13b
14b2
15
13b
16b
16b
21
6
6
5
5
4
4
14b1
14b
22
14b
13b1
12a1
13b
3
3
16a
13b2
16a
13a
13
13a
10

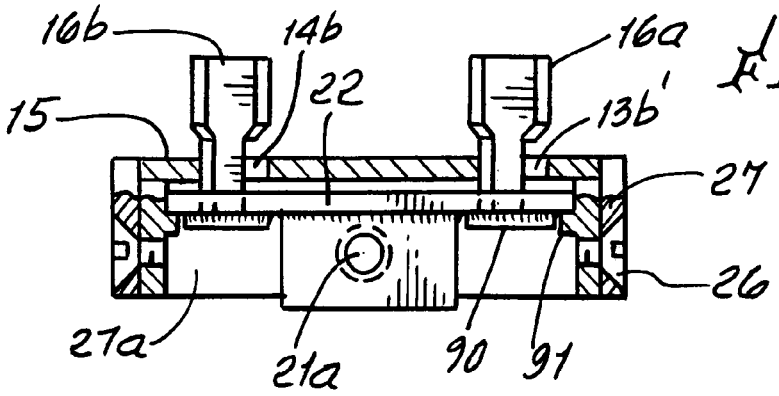
FIG. 7.
FIG. 8.
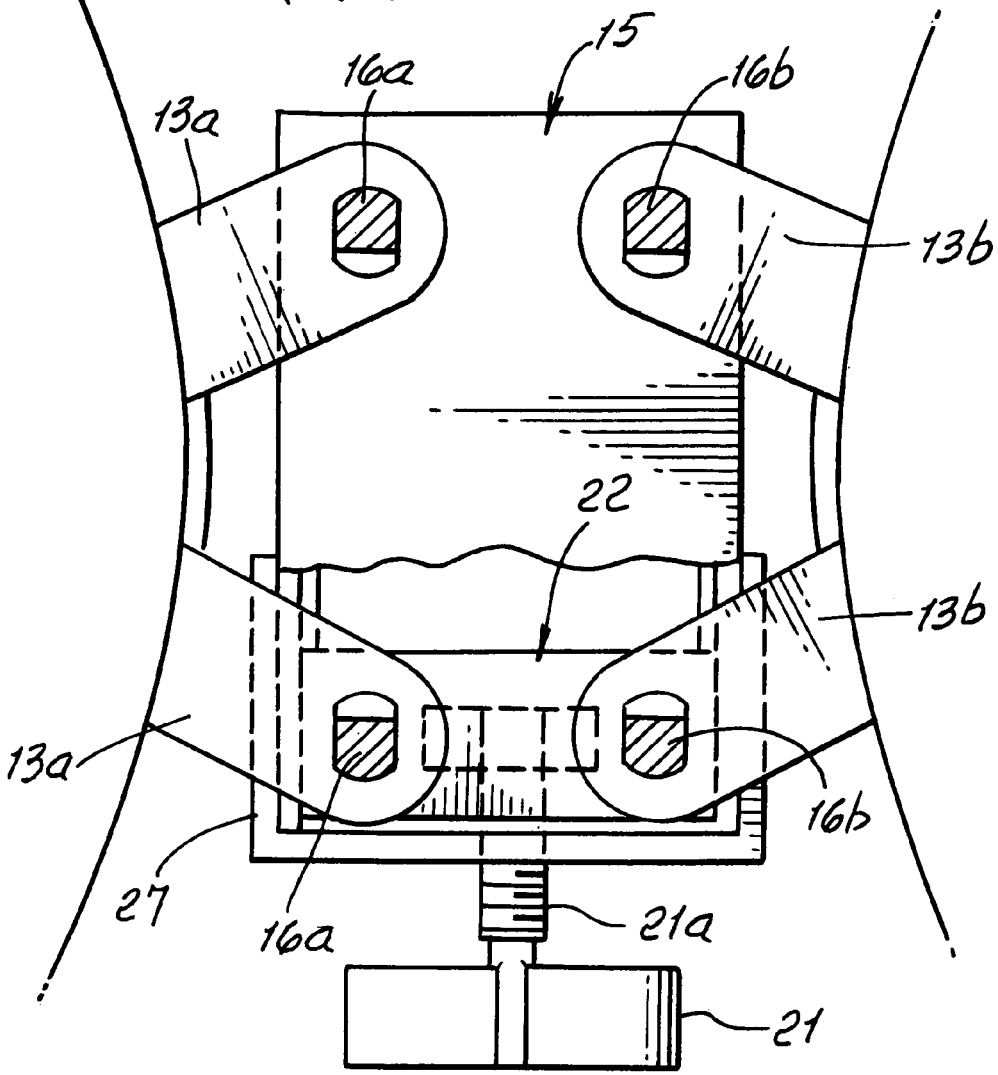

DRUM SUPPORT STRUCTURE

BACKGROUND OF THE INVENTION

This invention relates generally to mounting and spacing of multiple drums, and more particularly concerns clamping of two drums to an upright mounting means or support.

There is need for apparatus enabling rapid and efficient mounting of drum shells in secure, spaced apart relation, for use. In particular, there is need for a multiple drum mounting stand, having the highly advantageous combinations of elements, modes of operation, and provision of unusual results as are characteristic of the present invention.

SUMMARY OF THE INVENTION

It is a major object of the invention to provide simple, effective apparatus meeting the above needs. Basically such apparatus is adapted for use with dual drums each having a projecting bracket or brackets, defining at least one through opening, and comprising:

a) a carrier body connectable to the upright support, b) posts on the carrier body receivable in bracket openings, c) and adjustable mechanism on the carrier body for displacing at least one of the posts relative to at least one bracket opening to clamp at least two posts against the brackets.

As will be seen, there are typically four of such posts receivable in four bracket openings.

Another object includes provision of a plate defined by the carrier body, and from which at least two of the posts project in generally parallel relation, and said adjustable mechanism includes a handle projecting away from the plate for manual manipulation to displace said at least two posts.

A further object includes provision of a slider operatively connected between said handle and a bracket, and carrying two posts.

A yet further object includes provision of an upright support connected to said carrier body, between the two drums. An adjustable positioner may be provided on the support, below the level of the carrier body, for sideward engagement with the drums, to stabilize their positions relative to the upright.

These and other objects and advantages of the invention, as well as the details of an illustrative embodiment, will be more fully understood from the following specification and drawings, in which:

DRAWING DESCRIPTION

Figure 2:
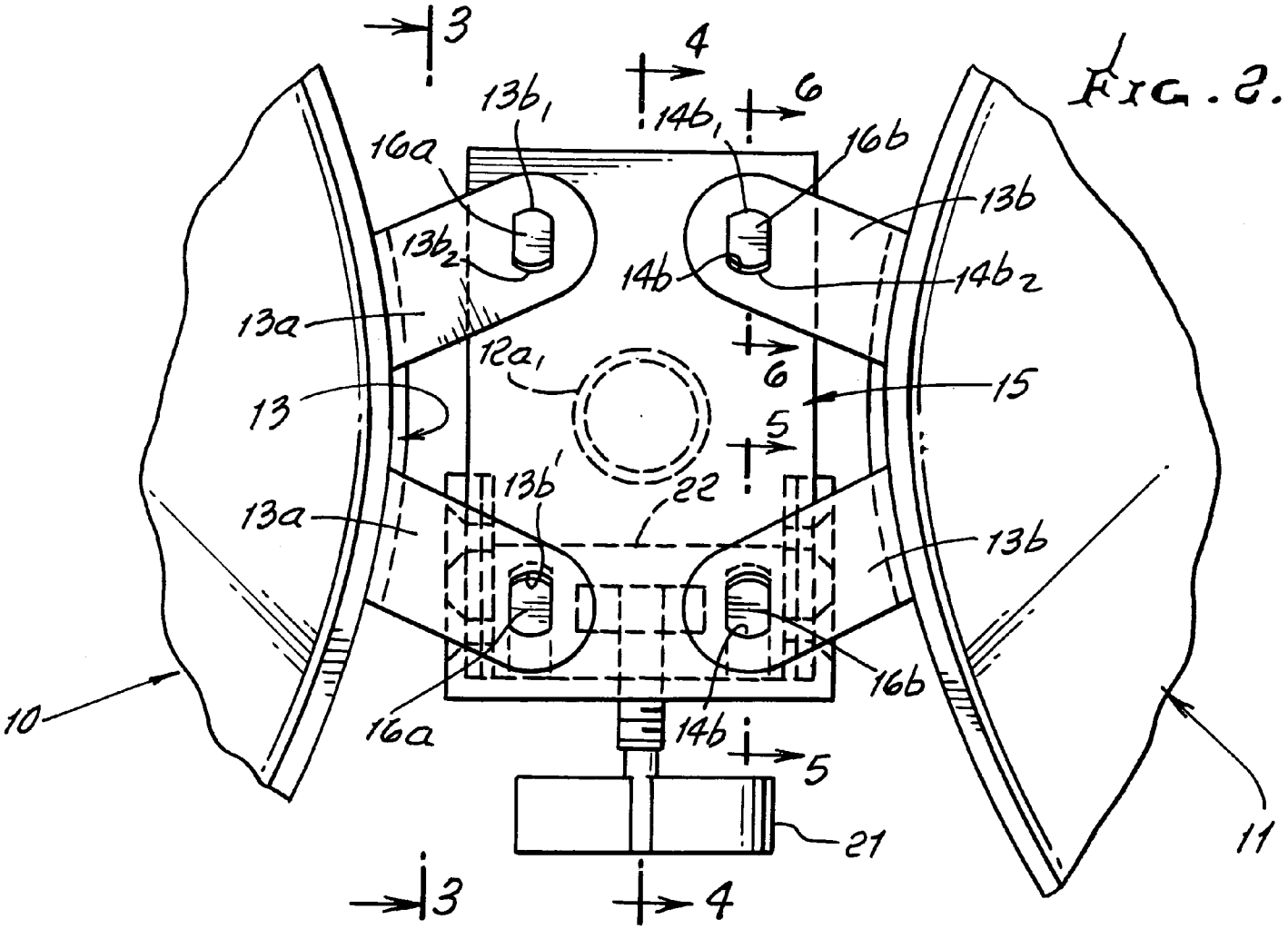
FIG. 2 is an enlarged fragmentary plan view, taken on lines 2-2 of FIG. 1.
Figure 4:
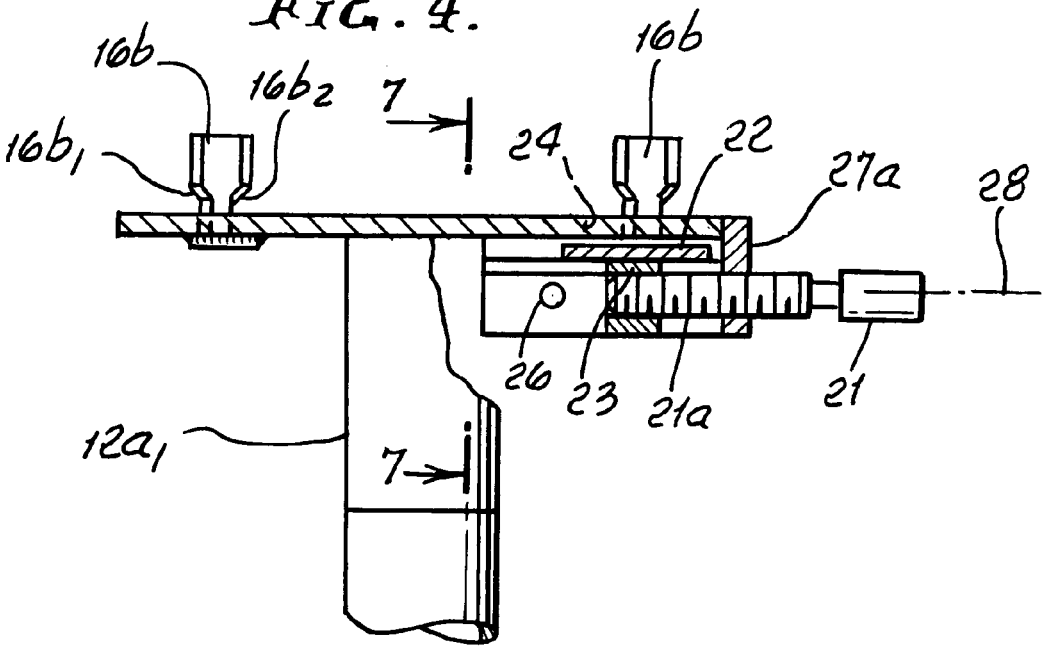
FIG. 4 is an elevation taken on lines 4-4 of FIG. 2.
Figure 5:
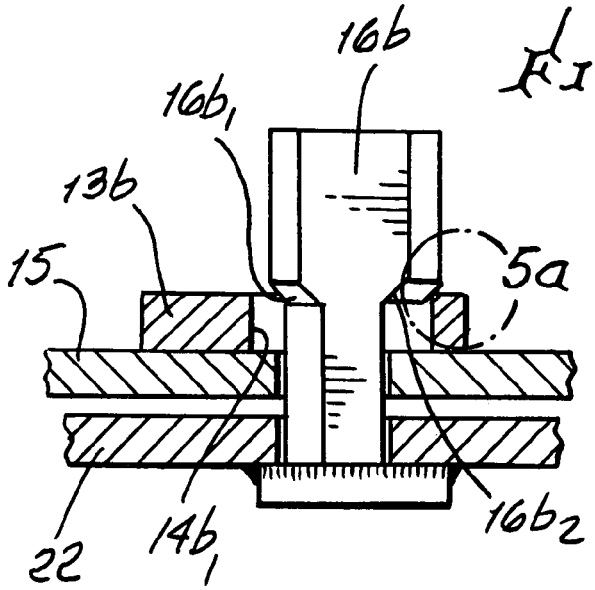
FIG. 5 is a further enlarged fragmentary elevation taken on lines 5-5 of FIG. 2.
Figure 5A:
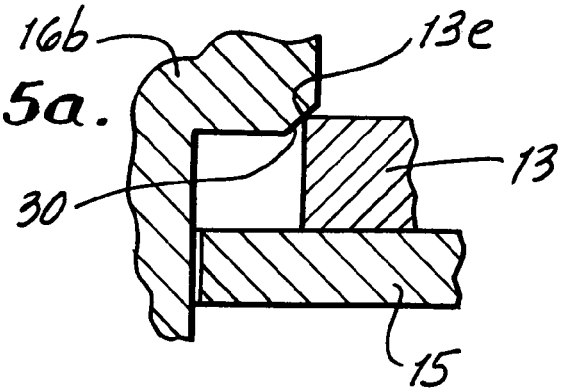
Figure 6:
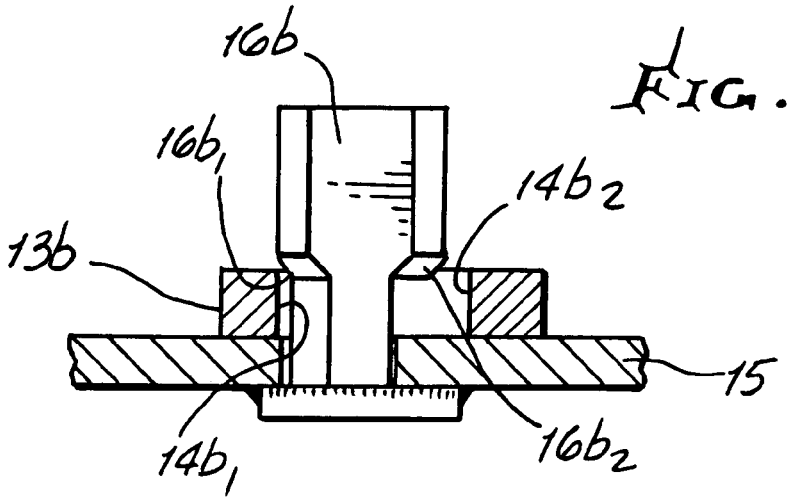
Figure 9:
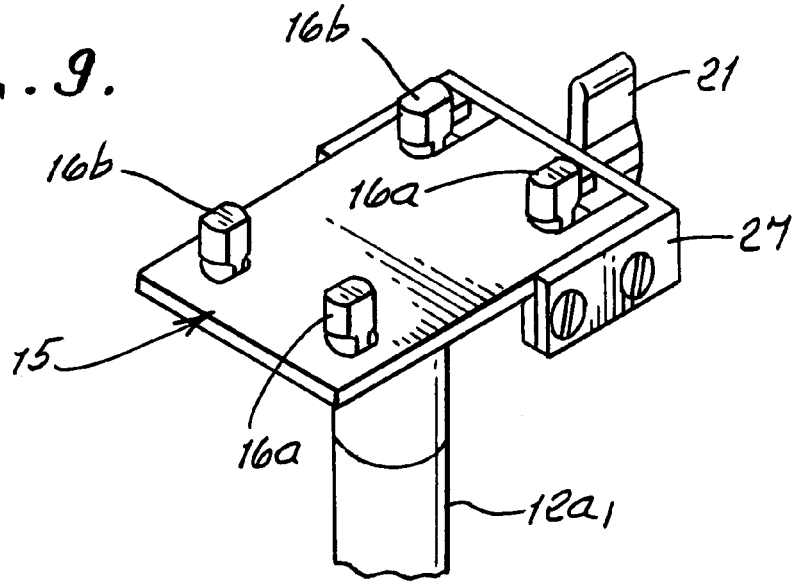
Figure 10:
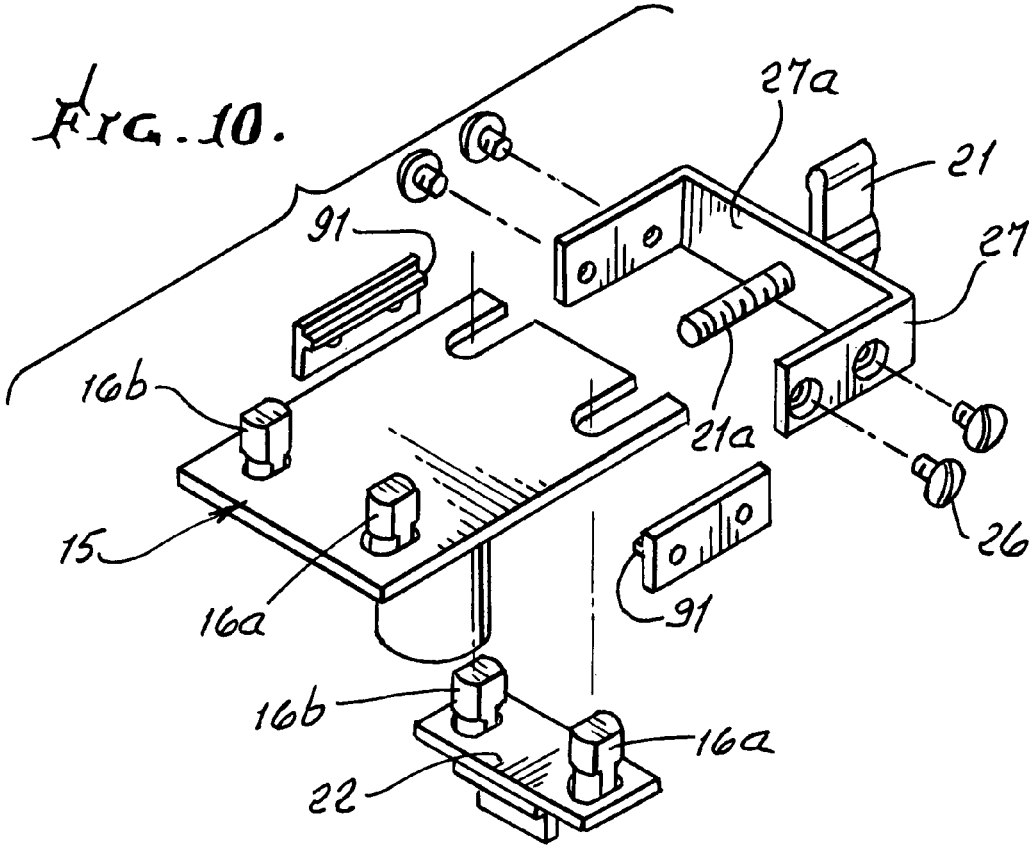

FIG. 5*a* is an enlarged fragmentary section showing clamping action;

FIG. 6 is a further enlarged fragmentary elevation taken on lines 6-6 of FIG. 2;

FIG. 7 is an elevation taken in section on lines 7-7 of FIG. 4;

FIG. 8 is a view like FIG. 2, showing a locked up condition of the brackets and posts;

FIG. 9 is a perspective view of carrier body plate and associated components mounted on an upright stand; and FIG. 10 is a view like FIG. 9 but showing the plate components exploded away from assembly to the plate.

DETAILED DESCRIPTION

Figure 1:
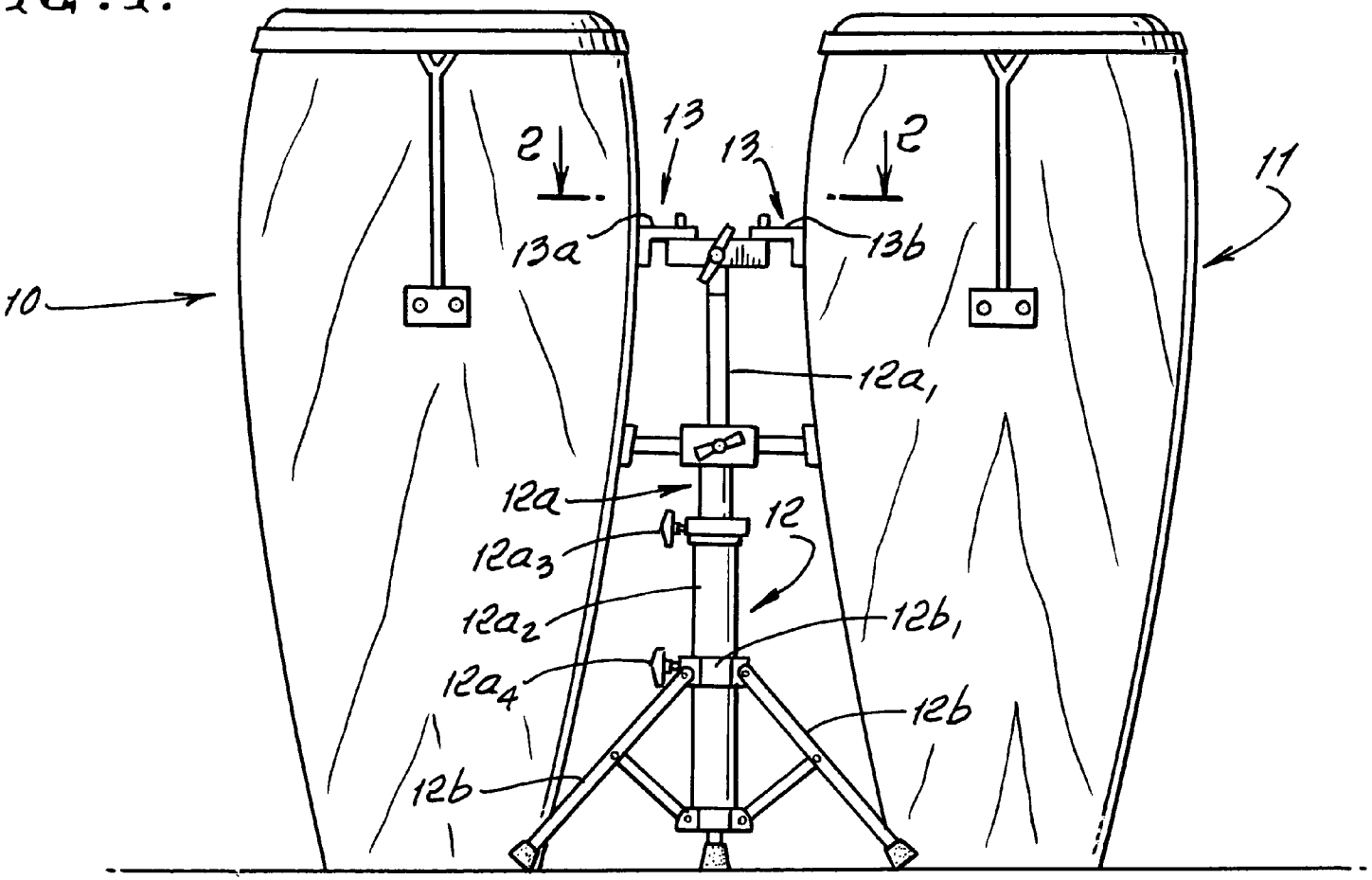
FIG. 1 is an elevation view of preferred apparatus incorporating the invention; and connected to two drums.

FIG. 1 shows two drums 10 and 11, which may be of Conga type, vertically elongated and alike, and assembled to an upright stand 12 having a standard or post 12*a*, and adjustable legs 12*b*. The post may have vertically adjustable sections $\mathbf{12}a_1$ and $\mathbf{12}a_2$, and tighteners $\mathbf{12}a_3$ to tighten the post sections together after vertical adjustment. A tightener $\mathbf{12}a_4$ tightens a clamp $\mathbf{12}b_1$ to section $\mathbf{12}a_2$ to adjust leg angles to support the stand relative to the drums.

The drums have two associated projecting brackets 13 connected to sides of the drums, the brackets having sidewardly projecting arms 13*a* and 13*b*, as for example are seen in FIG. 2. Such arms define vertical through openings 13*b*' and 14*b*.

A carrier body, in the form of a plate 15 is located between the drums and adjacent the brackets, so that posts 16*a* and 16*b* on the plate 15 are receivable in the bracket openings, as for example vertically.

Figure 3:
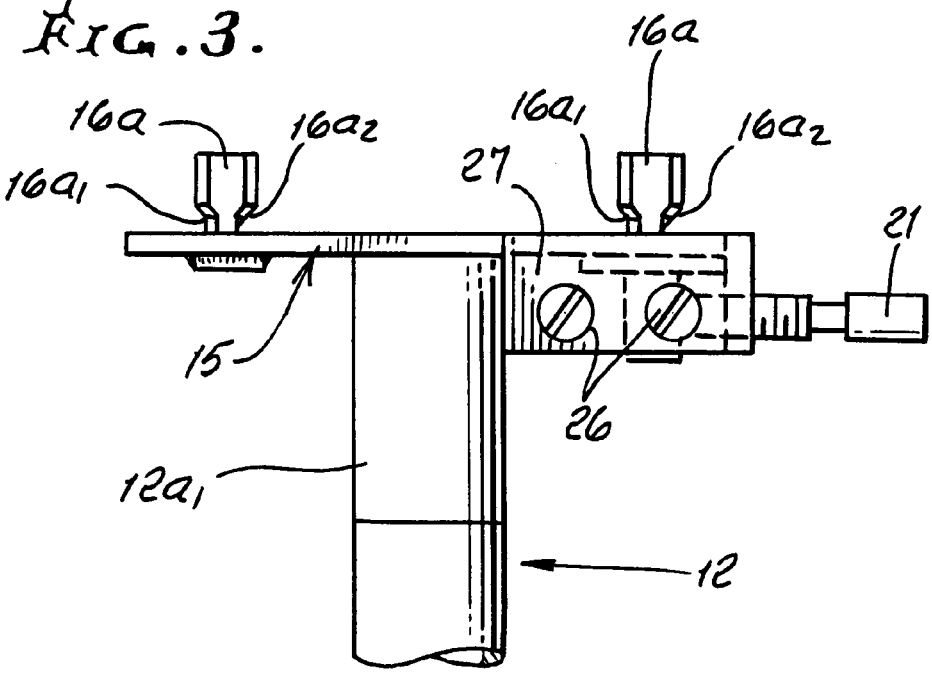
FIG. 3 is an elevation taken on lines 3-3 of FIG. 2.

Plate 15 is rigidly mounted on the stand 12, as on upper section $\mathbf{12}a_1$, and projects horizontally as seen in FIGS. 3 and 4. The posts are located to be upwardly receivable in or through the bracket openings, for example as shown, wherein posts 16*a* are receivable in through openings 13*b*' in bracket arms 13*a*; and posts 16*b* are receivable in a through openings 14*b* in bracket arms 13*b*. The posts 16*a* are laterally spaced from respective posts 16*b*; and the two posts 16*a* are adjustably longitudinally spaced apart, as are the two posts 16*b*. The opposite sides $\mathbf{16}a_1$, and $\mathbf{16}a_2$ of posts 16*a* extend longitudinally between longitudinally extending guide edges $\mathbf{13}b_1$ and $\mathbf{13}b_2$ of openings 13*b*; and likewise, the opposite sides $\mathbf{16}b_1$ and $\mathbf{16}b_2$ of posts 16*b* extend longitudinally between longitudinally extending guide edges $\mathbf{14}b_1$ and $\mathbf{14}b_2$ of openings 14*b*, whereby longitudinal adjustment play is achieved as between the plate and the posts. For this purpose, one of the two pairs of 13*b* and 14*b* openings may be longitudinally elongated, to accommodate longitudinal movement of the posts in those openings relative to posts in the other such pair of openings. Sides of the posts may be narrowed or tapered as in FIGS. 3 and 4, to accommodate to close and firm fitting with the edges of the bracket openings, upon tightening adjustment of the plate 15, described below. FIG. 5*a* shows post 16*b* tapered underside 30 having camming engagement with edge 13*e* of bracket 13 to hold the bracket clamped between the post and plate 15.

In accordance with an important object of the invention, adjustable mechanism is provided, as on carrier plate 15, for displacing at least one of the posts relative to at least one remaining post to clamp at least two posts against the brackets. Such mechanism may include a handle 21 projecting away from the carrier body or plate 15, for manual manipulation to displace at least one of the posts, to effect clamp-up. The mechanism may also include a slider, such as sub-plate 22, operatively connected between the handle 21 and two of the posts, for example posts 16*a* and 16*b* closest to the handle as seen in FIG. 2. That connection may include handle forward portion 21*a* extending beneath and connected at 23 to the slider 22 which in turn carries the relatively movable pair of posts 16*a* and 16*b* (those closest to the handle in the embodiment shown). An opening 24 in a plate 15 accommodates longitudinal movement of the connection 23. Plate 15 is connected to a U-shaped mounting bracket 27 attached via fasteners 26 to fixed plate 15. The handle 21 has threaded interfit with bracket 27 cross-piece 27*a*, whereby as the handle is rotated about axis 28, the slider moves longitudinally with the two adjustable posts 16*a* and 16*b*.

Movement of the slider in a longitudinal direction toward the handle acts to longitudinally separate the adjustable pair 16*a* and 16*b* of posts from the other pair, fixed to plate 15, acting to tighten all posts against the edges of openings in the bracket arms, and with mechanical advantage, tightening the connection of the plate 15 and stand 12 to the two drums. Quick release and separation of the drum connection is achieved by rotating the handle in the opposite direction, to free the posts for vertical separation from the bracket openings.

Adjustment of the legs of the stand and/or stand height, when the drums are connected, together with adjustment of the drum interconnection as described, achieves a very stable and effective assembly, easily made up and taken down, particularly for Conga style drums, which are vertically elongated.

The posts may be carried by brackets connected to the drum, and the adjustable plate may define the openings that receive the posts.

Post longitudinal displacement guide elements appear at 90 (movable) and 91 (fixed) in FIG. 7. In FIG. 8, the posts are longitudinally clamped to the brackets 13*a* and 13*b*.

Accordingly, it will be seen that the invention provides apparatus for clamping two drums to an upright support, the drums each having two projecting brackets each defining at least one through opening, comprising in combination a) a carrier body connectable to the upright support, b) first and second posts on the carrier body receivable in first and second bracket openings, a slider movable linearly sidewardly relative to said first and second posts, and third and fourth posts on the slider, and receivable in third and fourth bracket openings, c) and adjustable mechanism on the carrier body for displacing the slider and the third and fourth posts sidewardly relative to said first and second posts, to clamp said posts sidewardly against the brackets.

At least one of the first and second posts and openings is or may be utilized, and at least one of the third and fourth posts and openings is or may be utilized.

Note also that the direction of tightening to establish clamping is normal to an upright plane bisecting the two drums.

I claim:

1. Apparatus for clamping two drums to an upright support, the drums each having two projecting brackets each defining at least one through opening, comprising in combination a) a carrier body connectable to the upright support, b) first and second posts on the carrier body receivable in first and second bracket openings, a slider movable linearly sidewardly relative to said first and second posts, and third and fourth posts on the slider, and receivable in third and fourth bracket openings, c) and adjustable mechanism on the carrier body for displacing the slider and the third and fourth posts sidewardly relative to said first and second posts, to clamp said posts sidewardly against the brackets.

2. The combination of claim 1 wherein all of said posts have sides and all of said bracket openings have edges clamped against post sides.

3. The combination of claim 1 wherein said carrier body defines a plate from which said first and second posts project in generally parallel relation.

4. The combination of claim 1 wherein said adjustable mechanism includes a handle projecting away from the carrier body for manual manipulation to displace said slider and said third and fourth posts relative to the first and second posts.

5. The combination of claim 4 wherein said carrier body defines a plate from which said first and second posts project in generally parallel relation, and said adjustable mechanism includes a handle projecting away from the plate for manual manipulation to linearly displace said slider and said third and fourth posts directionally linearly away from the first and second posts.

6. The combination of claim 5 wherein there are four of said posts receivable in four bracket openings, respectively.

7. The combination of claim 4 wherein said mechanism includes a slider operatively connected between said handle and said at least one bracket.

8. The combination of claim 7 wherein the slider carries at least two posts, for clamp-up to at least two brackets.

9. The combination of claim 8 wherein the posts have tapered walls for clamping engagement with bracket edges.

10. The combination of claim 1 including said drums connected to said brackets.

11. The combination of claim 10 including said upright support connected to said carrier body, between the two drums.

12. The combination of claim 11 including an adjustable positioner on the upright support, below the level of the carrier body, for sideward engagement with the drums, to stabilize their positions relative to the upright.

13. A connection between two longitudinally upright drums, comprising:

a) first structure including through openings, b) second structure defining posts received in said openings having edges, c) one of said first and second structures connected to the drums, d) the other of said first and second structures being adjustable to tightly connect the posts sidewardly in the openings and only against edges of the openings, e) the direction of tightening being lateral and normal to an upright plane bisecting the two drums.

14. The connection of claim 13 wherein at least some posts have camming engagement with edges defined by the openings, for firm clamp-up.

* * * * *